US010082113B2

(12) United States Patent
Terai

(10) Patent No.: US 10,082,113 B2
(45) Date of Patent: Sep. 25, 2018

(54) EXHAUST-GAS RECIRCULATION DEVICE

(71) Applicant: FUJI JUKOGYO KABUSHIKI KAISHA, Tokyo (JP)

(72) Inventor: Yoshihiro Terai, Tokyo (JP)

(73) Assignee: SUBARU CORPORATION, Tokyo (JP)

( * ) Notice: Subject to any disclaimer, the term of this patent is extended or adjusted under 35 U.S.C. 154(b) by 0 days.

(21) Appl. No.: 15/453,236

(22) Filed: Mar. 8, 2017

(65) Prior Publication Data

US 2017/0284342 A1 Oct. 5, 2017

(30) Foreign Application Priority Data

Mar. 31, 2016 (JP) ..... 2016-071458

(51) Int. Cl.
*F02M 26/20* (2016.01)
*F02M 26/41* (2016.01)
(Continued)

(52) U.S. Cl.
CPC ..... *F02M 26/20* (2016.02); *F02M 26/41* (2016.02); *F02M 26/44* (2016.02); *F02M 35/104* (2013.01)

(58) Field of Classification Search
CPC ..... F02M 26/20; F02M 26/41; F02M 26/44; F02M 35/104
See application file for complete search history.

(56) References Cited

U.S. PATENT DOCUMENTS 4,151,819 A * 5/1979 Inada ..... F02M 26/56 123/568.2
8,051,841 B2 11/2011 Pantow et al.
(Continued)

FOREIGN PATENT DOCUMENTS

JP S63-21715 U 2/1988
JP 06-108928 4/1994
(Continued)

OTHER PUBLICATIONS

Japanese Office Action dated Dec. 26, 2017, in JP Patent Application No. 2016-071458 (7 pages in Japanese with English Translation).
(Continued)

*Primary Examiner* — Hieu T Vo
(74) *Attorney, Agent, or Firm* — Smith, Gambrell & Russell, LLP

(57) ABSTRACT

An exhaust-gas recirculation device is configured to be attached to a cylinder block including cylinders individually including built-in pistons and cause a portion of exhaust gas flowing through an exhaust system to recirculate to an intake system. The exhaust-gas recirculation device includes an intake manifold, a recirculation pipe, and a recirculation manifold. The intake manifold includes intake branches each including an intake passage communicating with an intake port and is configured to be disposed at the cylinder block. The recirculation pipe is coupled to an exhaust manifold capable of guiding the exhaust gas outward. The recirculation manifold includes recirculation branches each provided with a recirculation passage communicating with the intake passage via an introduction hole and is coupled to the recirculation pipe. The introduction hole has an inner diameter at a recirculation-passage side that is larger than an inner diameter at an intake-passage side.

4 Claims, 8 Drawing Sheets

(51) Int. Cl.
*F02M 35/104* (2006.01)
*F02M 26/44* (2016.01)

(56) References Cited

U.S. PATENT DOCUMENTS

| | | | | |
|---|---|---|---|---|
| 8,132,407 | B2 * | 3/2012 | Li | F02M 26/24 123/568.11 |
| 2015/0337771 | A1 | 11/2015 | Nagasaki et al. | |

FOREIGN PATENT DOCUMENTS

| | | | | | |
|---|---|---|---|---|---|
| JP | H07-103080 | | | 4/1995 | |
| JP | 2001-207918 | | | 8/2001 | |
| JP | 2008-190409 | A | | 8/2008 | |
| JP | 2010-521619 | A | | 6/2010 | |
| JP | 2015-224561 | A | | 12/2015 | |
| JP | 2017036701 | A | * | 2/2017 | F02D 21/08 |

OTHER PUBLICATIONS

Japanese Office Action dated Aug. 15, 2017, in JP Patent Application No. 2016-071485 (8 pages in Japanese with English Translation).
Japanese Office Action dated Oct. 24, 2017, in JP Patent Application No. 2016-071485 (6 pages in Japanese with English Translation).

* cited by examiner

EXHAUST-GAS RECIRCULATION DEVICE

CROSS-REFERENCE TO RELATED APPLICATIONS

The present application claims priority from Japanese Patent Application No. 2016-071458 filed on Mar. 31, 2016, the entire contents of which are hereby incorporated by reference.

BACKGROUND

1. Technical Field

The present invention relates to an exhaust-gas recirculation device that extracts, from an exhaust system, a portion of exhaust gas from an engine and introduces the exhaust gas to an intake system.

2. Related Art

Some engines are equipped with an exhaust-gas recirculation (EGR) device that extracts a portion of exhaust gas from an exhaust system and returns the extracted exhaust gas to an intake system of the engine again so as to add the extracted exhaust gas to the air-fuel mixture. Such an exhaust-gas recirculation device has an exhaust-gas recirculation pipe. The exhaust-gas recirculation pipe is provided between intake branch pipes, which branch off from an intake manifold to individual intake ports, and an exhaust manifold.

An exhaust-gas recirculation device disclosed in Japanese Unexamined Patent Application Publication (JP-A) No. 2001-207918 includes a cylindrical chamber disposed between an internal combustion engine and an intake manifold and exhaust-gas recirculation pipes that supply exhaust gas introduced into the chamber from an exhaust pipe to intake branches. The exhaust-gas recirculation pipes are coupled to introduction holes provided in the intake branches, and the exhaust gas is introduced to the intake branches via the introduction holes.

An exhaust-gas recirculation device disclosed in JP-A No. 6-108928 includes an exhaust-gas distribution block attached astride intake branch passages of an intake manifold. The exhaust-gas distribution block is provided with an EGR chamber. Exhaust gas introduced into the EGR chamber is introduced into the intake manifold via branches that form introduction holes provided in the distribution block.

An intake module disclosed in U.S. Pat. No. 8,051,841 includes an intake manifold, which has a plurality of intake ports and supplies an air-fuel mixture to an engine, and an exhaust-gas recirculation manifold, which is attached to the intake manifold and supplies exhaust gas to the air-fuel mixture. The intake manifold is provided with exhaust-gas-introduction openings, and the exhaust gas is introduced to the air-fuel mixture via the openings.

In each exhaust-gas recirculation device in the related art, the exhaust gas is introduced to fresh air inside the intake branches via the introduction holes, namely, introduction ports, provided in the intake branches. The fresh air flowing through the intake system and the exhaust gas flowing through the exhaust system pulsate, sometimes causing the fresh air to be supplied to the intake ports of the cylinders via the intake branches of the intake manifold to flow backward toward the exhaust-gas recirculation pipe. If the fresh air flows backward toward the exhaust-gas recirculation pipe, namely, a recirculation passage, and enters the recirculation passage, the amount of fresh air to be supplied into the cylinders would change in the cylinders. When the fresh air flows backward in the recirculation passage in this manner, the combustion efficiency of the engine deteriorates.

SUMMARY OF THE INVENTION

It is desirable to suppress backflow of fresh air flowing through an intake system toward an exhaust-gas recirculation pipe so as to improve the combustion efficiency of an engine.

An aspect of the present invention provides an exhaust-gas recirculation device that is configured to be attached to a cylinder block including cylinders individually including built-in pistons and cause a portion of exhaust gas flowing through an exhaust system to recirculate to an intake system. The exhaust-gas recirculation device includes an intake manifold that has intake branches each including an intake passage communicating with an intake port and that is configured to be disposed at the cylinder block, a recirculation pipe coupled to an exhaust manifold capable of guiding the exhaust gas outward, and a recirculation manifold that includes recirculation branches each provided with a recirculation passage communicating with the intake passage via an introduction hole and that is coupled to the recirculation pipe. The introduction hole has an inner diameter at a recirculation-passage side that is larger than an inner diameter at an intake-passage side.

The introduction hole may be any one of a curved surface, a tapered surface, and a stepped tapered surface constituted of a straight surface at the intake-passage side and a tapered surface at the recirculation-passage side.

The intake manifold may be configured to be disposed at an upper side of the cylinder block, and the recirculation manifold may be configured to be disposed between the intake manifold and the cylinder block.

DETAILED DESCRIPTION

Figure 1:
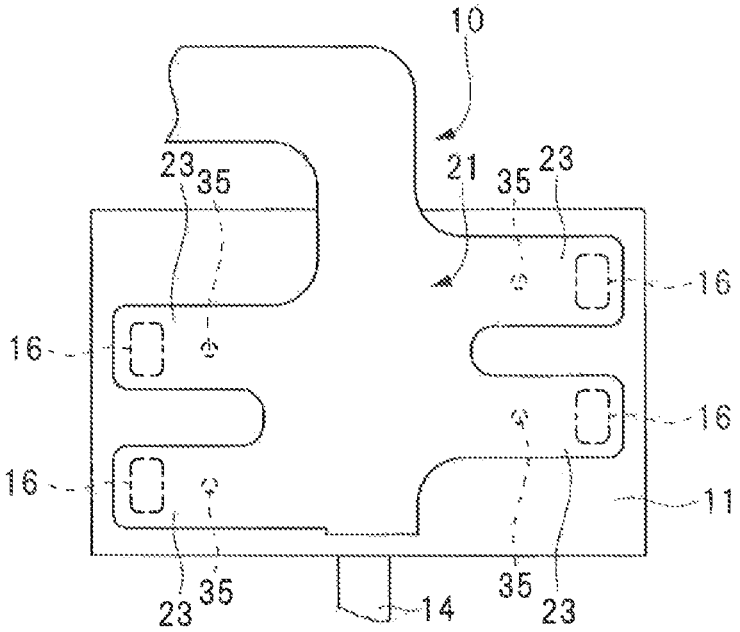
FIG. 1 is a plan view schematically illustrating an exhaust-gas recirculation device according to an implementation.
Figure 2:
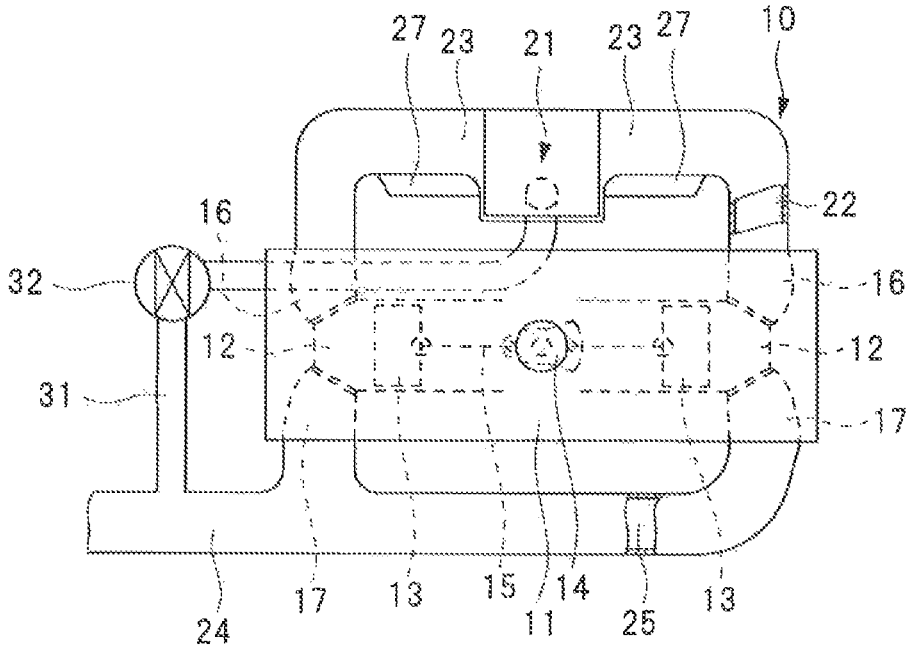
FIG. 2 is a front view of FIG. 1.

An implementation of the present invention will be described in detail below with reference to the drawings. As illustrated in FIGS. 1 and 2, an exhaust-gas recirculation device 10 causes a portion of exhaust gas flowing through an exhaust system to recirculate to an intake system so as to suppress the occurrence of $NO_x$ to be emitted outward from the exhaust system. An engine serving as a drive source for a vehicle has a cylinder block 11. The cylinder block 11 has cylinder bores, namely, cylinders 12. Each cylinder 12 has a built-in piston 13 capable of moving in a reciprocating manner. The cylinder block 11 illustrated in FIGS. 1 and 2 has four cylinders 12 extending in the horizontal direction, and the built-in pistons 13 in the respective cylinders 12 reciprocate in the horizontal direction. Accordingly, the engine illustrated in the drawings is a horizontally-opposed four-cylinder engine.

A crankshaft 14 is rotatably attached to a central area of the cylinder block 11, and two pistons 13 are installed at each of the left and right sides of the cylinder block 11 in FIGS. 1 and 2 with respect to the crankshaft 14 in the center. The pistons 13 are individually coupled to the crankshaft 14 by connecting rods 15. A linear reciprocating motion of the pistons 13 is converted into a rotational motion of the crankshaft 14 via the connecting rods 15, and the rotational torque of the crankshaft 14 is transmitted to driving wheels (not illustrated). The cylinders 12 and the pistons 13 are offset from one another in the direction parallel to the crankshaft 14 in FIG. 1.

Intake ports 16 communicating with the cylinders 12 are formed in the upper surface of the cylinder block 11. As illustrated in FIG. 1, the intake ports 16 of two of the cylinders 12 are provided at one of the left and right ends of the cylinder block 11, whereas the intake ports 16 of the remaining two cylinders 12 are provided at the other one of the left and right ends of the cylinder block 11. Exhaust ports 17 communicating with the cylinders 12 are formed in the lower surface of the cylinder block 11. As illustrated in FIG. 1, the exhaust ports 17 of two of the cylinders 12 are provided at one of the left and right ends of the cylinder block 11, whereas the exhaust ports 17 of the remaining two cylinders 12 are provided at the other one of the left and right ends of the cylinder block 11.

An intake manifold 21 constituting an intake system for supplying fresh air to the cylinders 12 is disposed at the upper surface of the cylinder block 11. The intake manifold 21 includes four intake branches, namely, intake branches 23, having intake passages 22 that communicate with the respective intake ports 16. An end of each intake branch 23 is fixed to the upper surface of the cylinder block 11.

An exhaust manifold 24 constituting an exhaust system for emitting exhaust gas outward from the cylinders 12 is disposed at the lower surface of the cylinder block 11. The exhaust manifold 24 has exhaust passages 25 communicating with the respective exhaust ports 17. Exhaust gas emitted from the four exhaust ports 17 is collected and guided to an exhaust muffler via an exhaust catalyst and is emitted outward.

Figure 3:
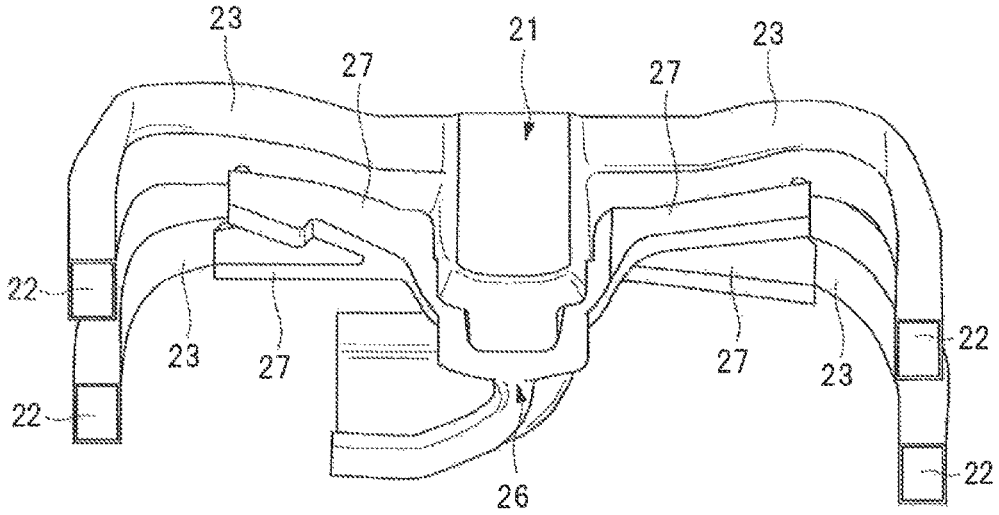
FIG. 3 is a perspective view of an intake manifold and a recirculation manifold illustrated in FIG. 2, as viewed from below.
Figure 4:
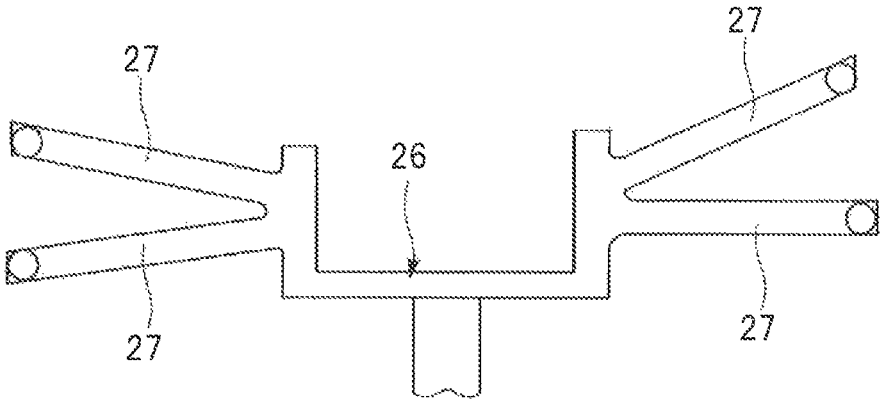
FIG. 4 is a plan view of the recirculation manifold.

A recirculation manifold 26 is attached below the intake manifold 21. FIG. 3 is a perspective view of the intake manifold 21 and the recirculation manifold 26, as viewed from below. FIG. 4 is a plan view of the recirculation manifold 26.

The recirculation manifold 26 includes four recirculation branches 27 extending along the respective intake branches 23. The recirculation branches 27 individually have recirculation passages 28, and the recirculation branches 27 are integrally coupled to the recirculation manifold 26. As illustrated in FIG. 2, a recirculation pipe 31 is coupled between the recirculation manifold 26 and the exhaust manifold 24 such that a portion of exhaust gas emitted from the exhaust ports 17 to the exhaust manifold 24 recirculates to the intake branches 23 constituting the intake system. As illustrated in FIG. 2, the recirculation pipe 31 is provided with a recirculation control valve 32 for controlling the flow rate of exhaust gas recirculating to the intake branches 23.

Figure 5:
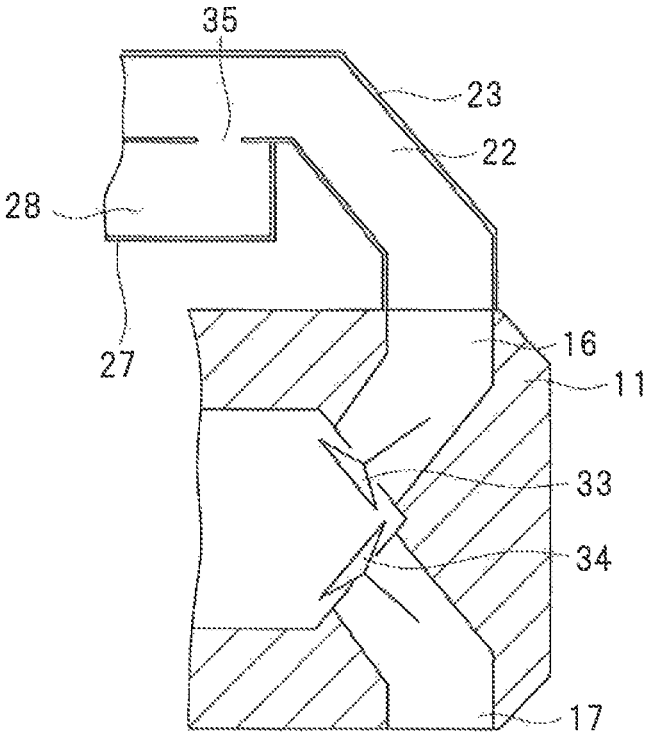
FIG. 5 is a cross-sectional view illustrating an intake branch coupled to a recirculation branch and a part of a cylinder block.
Figure 6:
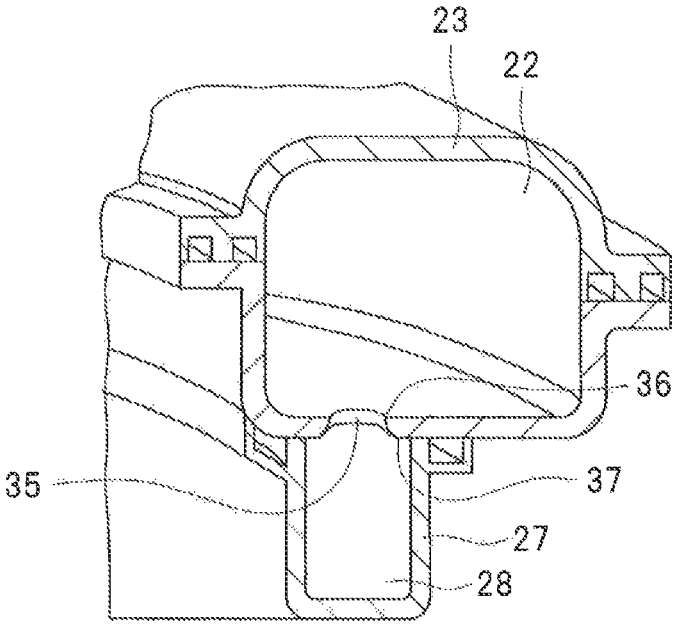
FIG. 6 is a perspective view illustrating a cross section of parts of the intake branch and the recirculation branch.

FIG. 5 is a cross-sectional view illustrating each intake branch 23 coupled to the corresponding recirculation branch 27 and a part of the cylinder block 11, and FIG. 6 is a perspective view illustrating a cross section of parts of the intake branch 23 and the recirculation branch 27. As illustrated in FIG. 5, each intake port 16 is opened and closed by an intake valve 33, and each exhaust port 17 is opened and closed by an exhaust valve 34. The intake valves 33 and the exhaust valves 34 are opened and closed by being driven by valve driving mechanisms (not illustrated). The intake branches 23 individually have introduction holes 35, and each introduction hole 35 is located at an end of the corresponding recirculation branch 27.

When the engine is activated, fresh air is supplied to the intake manifold 21 constituting the intake system. The fresh air is then distributed from the intake manifold 21 to the intake passages 22 in the respective intake branches 23 so as to be supplied to the intake ports 16. Gas combusted in the cylinders 12 is emitted from the exhaust ports 17 to the exhaust manifold 24. A portion of the emitted exhaust gas recirculates to the recirculation manifold 26 via the recirculation pipe 31. The exhaust gas recirculated to the recirculation manifold 26 is recirculated and supplied to the intake passages 22 in the intake branches 23 from the recirculation passages 28 in the recirculation branches 27 via the introduction holes 35.

Because the recirculation manifold 26 is disposed below the intake manifold 21, even if condensed water is produced in the intake manifold 21, the condensed water drips down from the introduction holes 35 onto the bottom of the recirculation branches 27 so as to be trapped within the recirculation manifold 26.

Figure 7A:
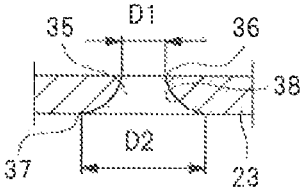
FIG. 7A is a cross-sectional view of an introduction hole illustrated in FIG. 6.
Figure 7B:
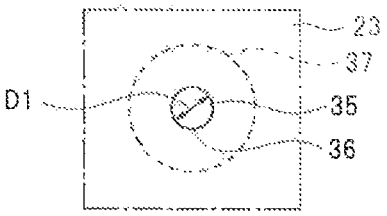
FIG. 7B is a plan view of FIG. 7A.
Figure 7C:
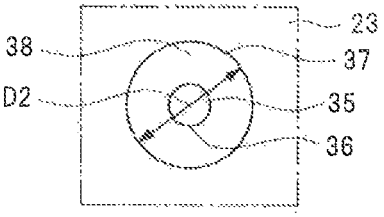
FIG. 7C is a bottom view of FIG. 7A.

FIG. 7A is a cross-sectional view of the introduction hole 35 illustrated in FIG. 6, FIG. 7B is a plan view of FIG. 7A, and FIG. 7C is a bottom view of FIG. 7A.

Assuming that each introduction hole 35 has an opening 36, at the intake-passage-22 side, with an inner diameter D1 and an opening 37, at the recirculation-passage-28 side, with an inner diameter D2, the inner diameter D2 at the recirculation-passage side is set to be larger than the inner diameter D1 at the intake-passage side. In the introduction hole 35, a section 38 thereof between the two openings 36 and 37 is a curved surface that protrudes inward. Accordingly, the inner diameter D2 of the opening 37 at the recirculation-passage side, namely, the outer surface of the intake branch 23, is larger than the inner diameter D1 of the opening 36 at the intake-passage side, namely, the inner surface of the intake branch 23. Specifically, by setting the inner diameter D1 at the intake-passage side to be smaller than the inner diameter D2 at the recirculation-passage side, the airflow resistance of the flow of fresh air from the intake passage 22 toward the recirculation passage 28 becomes larger than the airflow resistance of the flow of exhaust gas from the recirculation passage 28 toward the intake passage 22. Consequently, the occurrence of a phenomenon in which the fresh air flows backward from the intake passage 22 toward the recirculation passage 28 can be suppressed without lowering the flow rate of exhaust gas flowing from the recirculation passage 28 toward the intake passage 22.

Therefore, even if the fresh air flowing through the intake system and the exhaust gas flowing through the exhaust system pulsate, the fresh air to be supplied to the intake ports 16 of the cylinders 12 from the intake branches 23 of the intake manifold 21 is prevented from flowing backward toward the recirculation pipe 31 from the recirculation branches 27. Accordingly, the combustion efficiency of the engine can be improved while purifying the exhaust gas.

Figure 8A:
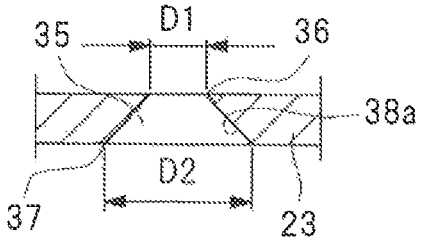
FIG. 8A is a cross-sectional view illustrating a modification of the introduction hole.
Figure 8B:
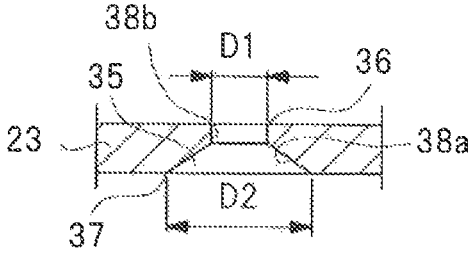
FIG. 8B is a cross-sectional view illustrating another modification of the introduction hole.

FIGS. 8A and 8B are cross-sectional views illustrating modifications of each introduction hole 35. In the introduction hole 35 illustrated in FIG. 8A, a section 38*a* thereof between the two openings 36 and 37 is a tapered surface having an inner diameter that gradually increases from the intake-passage side toward the recirculation-passage side. In contrast, in the introduction hole 35 illustrated, in FIG. 8B, a section thereof between the two openings 36 and 37 is a stepped tapered surface having a tapered surface 38*a* at the recirculation-passage side and a straight surface 38*b* at the intake-passage side.

In either modification, the inner diameter D2 of the edge of the opening 37 at the recirculation-passage side is set to be larger than the inner diameter D1 of the edge of the opening 36 at the intake-passage side. Thus, the amount of exhaust gas recirculating to the intake passages 22 can be increased, and the occurrence of backflow of fresh air entering the recirculation passages 28 from the intake passages 22 can be suppressed.

Figure 9:
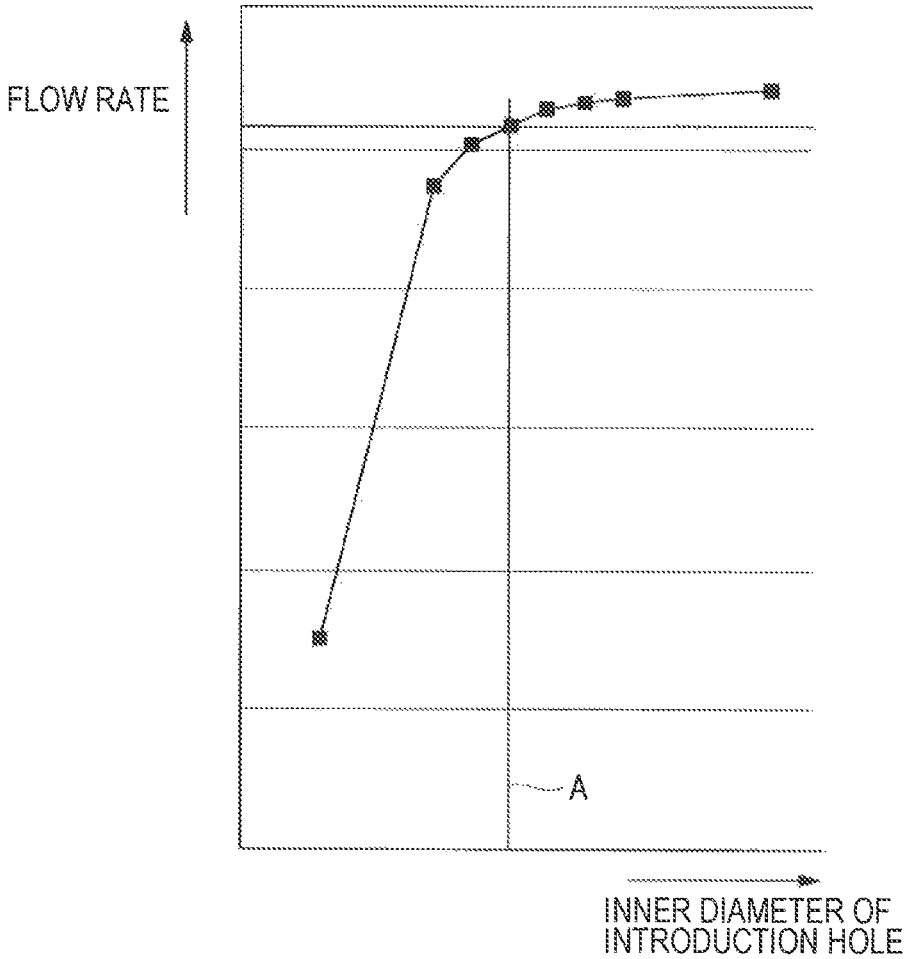
FIG. 9 is an introduction-hole characteristic-line diagram illustrating the relationship between the exit-side diameter of an introduction hole and the flow rate of exhaust gas toward an intake branch in a case where the introduction hole is a straight hole.

FIG. 9 is an introduction-hole characteristic-line diagram illustrating the relationship between the exit-side diameter of an introduction hole and the flow rate of exhaust gas toward an intake passage in a case where the introduction hole is a straight hole.

In FIG. 9, the abscissa axis indicates the inner diameter of the straight introduction hole, whereas the ordinate axis indicates the flow rate of exhaust gas recirculating from the recirculation passage 28 to the intake passage 22. When the inner diameter of the introduction hole is increased, the flow rate also increases. However, when the diameter of the introduction hole, namely, the inner diameter thereof, exceeds a specific threshold value A, the increment of the flow rate decreases starting from the threshold value A for the inner diameter as an inflection point. Due to this tendency, the threshold value A for the inner diameter where the increment of the flow rate starts to decrease is set to a minimum diameter of the introduction hole. This tendency is common among many engines without being dependent on, for instance, the magnitude of engine displacement and is the same in the case where the inner diameter of each introduction hole 35 is larger at the intake-passage side than at the recirculation-passage side.

Therefore, by setting the inner diameter to be determined in accordance with the threshold value A to the inner diameter of the openings 36 at the intake-passage side, the backflow of fresh air can be suppressed while ensuring the flow rate of exhaust gas recirculating to the intake passages 22.

The engine illustrated in FIGS. 1 and 2 is a horizontally-opposed engine in which the intake manifold 21 is disposed at the upper side of the cylinder block 11 and the recirculation manifold 26 is disposed between the intake manifold 21 and the cylinder block 11. With the recirculation manifold 26 being disposed below the intake manifold 21 in this manner, even if condensed water is produced in the intake passages 22 in the intake manifold 21, the condensed water flowing along the bottom of the intake branches 23 drips down from the introduction holes 35 onto the bottom of the recirculation branches 27 so as to be trapped within the recirculation branches 27 and the recirculation manifold 26. Consequently, the condensed water is prevented entering the intake ports 16, whereby the combustion efficiency of the engine can be improved.

The implementation of the present invention is not limited to that described above, and various modifications are possible so long as they do not depart from the scope of the invention. The exhaust-gas recirculation device according to the implementation of the present invention can be applied to other types of engines, in addition to the horizontally-opposed engine. Furthermore, the exhaust-gas recirculation device according to the implementation of the present invention can also be applied to an engine in which the intake manifold 21 is disposed beside a side surface of the cylinder block 11 instead of being disposed at the upper side of the cylinder block 11.

The invention claimed is:

1. An exhaust-gas recirculation device that is configured to be attached to a cylinder block comprising cylinders individually comprising built-in pistons and to cause a portion of exhaust gas flowing through an exhaust system to recirculate to an intake system, the exhaust-gas recirculation device comprising:

an intake manifold that comprises intake branches each comprising an intake passage communicating with an intake port and that is configured to be disposed at the cylinder block;

a recirculation pipe coupled to an exhaust manifold capable of guiding the exhaust gas outward; and a recirculation manifold that comprises recirculation branches each provided with a recirculation passage communicating with a corresponding one of the intake passages via an introduction hole and that is coupled to the recirculation pipe, wherein the introduction hole has an inner diameter at a recirculation-passage side that is larger than an inner diameter at an intake-passage side.

2. The exhaust-gas recirculation device according to claim 1, wherein the introduction hole is any one of a curved surface, a tapered surface, and a stepped tapered surface constituted of a straight surface at the intake-passage side and a tapered surface at the recirculation-passage side.

3. The exhaust-gas recirculation device according to claim 2, wherein the intake manifold is configured to be disposed at an upper side of the cylinder block, and the recirculation manifold is configured to be disposed between the intake manifold and the cylinder block.

4. The exhaust-gas recirculation device according to claim 1, wherein the intake manifold is configured to be disposed at an upper side of the cylinder block, and the recirculation manifold is configured to be disposed between the intake manifold and the cylinder block.

* * * * *